US006233796B1

(12) United States Patent
van Wassenhove et al.

(10) Patent No.: US 6,233,796 B1
(45) Date of Patent: May 22, 2001

(54) WIRING HARNESS BUNDLING

(75) Inventors: Denis van Wassenhove, Crepy-en-Valois (FR); Carol Jayne Pindar, Daventry (GB)

(73) Assignee: Federal-Mogul Systems Protection Group S.A.S., Crepy-en-Valois (FR)

( * ) Notice: Subject to any disclaimer, the term of this patent is extended or adjusted under 35 U.S.C. 154(b) by 0 days.

(21) Appl. No.: 09/254,619

(22) PCT Filed: Sep. 12, 1997

(86) PCT No.: PCT/GB97/02459

§ 371 Date: Jun. 8, 1999

§ 102(e) Date: Jun. 8, 1999

(87) PCT Pub. No.: WO98/11564

PCT Pub. Date: Mar. 19, 1998

(30) Foreign Application Priority Data

Sep. 14, 1996 (GB) ..... 9619259

(51) Int. Cl.[7] ..... B65H 54/00; B65H 69/04

(52) U.S. Cl. ..... 28/100; 289/1.5

(58) Field of Search ..... 28/101, 100, 102, 28/140, 299; 289/1.5, 16.5, 17, 18.1; 140/93 R, 93 A, 93.2, 111; 174/72 A, 71 R, 135; 66/3, 4, 1 R; 87/5, 6, 12, 13; 138/106, 178; 139/383 R, 384 R, 387 R, 389, 407

(56) References Cited

U.S. PATENT DOCUMENTS

| | | | | |
|---|---|---|---|---|
| 3,252,723 | * | 5/1966 | Burke | 289/1.5 |
| 3,565,127 | * | 2/1971 | Nicely et al. | 87/6 |
| 3,571,863 | * | 3/1971 | Logan | 174/72 |
| 3,670,783 | * | 6/1972 | Goodwill | 140/93 R |
| 3,700,010 | * | 10/1972 | Bartilson et al. | 140/93 A |
| 4,384,167 | * | 5/1983 | Nestor | 174/71 R |
| 4,415,765 | * | 11/1983 | Iwasa et al. | 174/72 A |
| 4,558,894 | | 12/1985 | Detterbeck et al. | 289/1.5 |
| 4,774,903 | * | 10/1988 | Goold et al. | 87/6 |
| 5,016,859 | | 5/1991 | Zimmer et al. | 254/134.3 |
| 5,221,390 | * | 6/1993 | Persson et al. | 28/101 |
| 5,300,337 | | 4/1994 | Andrieu et al. | 428/36.1 |
| 5,467,802 | | 11/1995 | Lusen et al. | 139/384 R |
| 6,082,144 | * | 6/2000 | Jencks et al. | 87/6 |

FOREIGN PATENT DOCUMENTS

| | | | |
|---|---|---|---|
| 441 511 | 8/1991 | (EP) | H02G/3/04 |
| 1038095 | 8/1966 | (GB) | H01B/13/00 |
| WO 93/09281 | 5/1993 | (WO) | D03D/3/02 |
| WO 95/20229 | 7/1995 | (WO) | H01B/13/00 |

* cited by examiner

*Primary Examiner*—Amy B. Vanatta
(74) *Attorney, Agent, or Firm*—Synnestvedt & Lechner LLP

(57) ABSTRACT

A method of applying a knotted lacing cord or yarn to an elongated bundle of electrical wires comprises the steps of forming a set of loosely knotted adjacent loops of larger diameter than the bundle from a continuous length of a lacing cord, passing the plurality of loops over a free end of the bundle, securing the first loop at an adjacent said free end by knotting or otherwise clamping it thereto followed by pulling on the free opposite end of the lacing cord to progressively tighten successive loops about the bundle, at spaced intervals along the length of the latter.

8 Claims, 3 Drawing Sheets

WIRING HARNESS BUNDLING

This invention relates primarily, but not exclusively, to the bundling of electrical wiring harnesses or other such elongate assemblies. Numerous methods of bundling cable/wire assemblies are in common use. Braided tubular sleeving is widely used as are adhesive tape and plastics cable ties. It is also common to employ a low cost lacing yarn, thread or cord, which is knotted around the wire bundle at spaced intervals, the lacing yarn being continuous so that it extends alongside the wire bundle between successive knots.

The application of lacing yarns of this kind is labour-intensive, which offsets the low cost of the yarn itself, because each knot has to be tied firmly before moving along to make the next knot in the series. Accordingly, more expensive bundling methods are often preferred because they are less labour intensive.

Such elongate assemblies may be other than electrical wiring harnesses and with this in mind it is appropriate to preserve the generality of the invention by considering it in relation to applying a lacing yarn to an elongate substrate.

In this specification the term slip knot is used to mean a knot formed by a loop in a single cord or by interengagement between loops whereby the position of each loop is dependant upon the tension in the cord. Also a slip knot expanded to define a loop of greater cross section than a said substrate is referred to herein as a loosely knotted loop.

It is an object of the present invention to at least reduce the time taken to apply a lacing yarn, as well as to at least in part automate its application.

According to the present invention, a method of applying a knotted lacing yarn to an elongated substrate such as a bundle of electrical wires comprises the steps of forming a set of loosely knotted adjacent loops of larger diameter than the bundle from a continuous length of a lacing yarn, passing the plurality of loops over a free end of the bundle, securing the first loop at or adjacent said free end by knotting or otherwise clamping it thereto followed by progressively displacing said set of loops away from said first loop lengthwise of the substrate so as to progressively tighten successive loops about the bundle, at spaced intervals along the length of the latter.

According to one embodiment of the invention, the set of loosely knotted loops exhibits a progressively decreasing diameter from one end of the set to the other, the smallest diameter of the set being at that end of the set which in use forms the first loop. By producing a set of loops progressively decreasing (or increasing) diameter from one end to the other, it is easier to ensure both sensibly uniform knot spacing and uniform lacing yarn tension.

Advantageously, the set of loosely knotted loops is provided on a tapered or conical former to prevent or at least minimise the risk of tangling. Alternatively, the set may be waxed or otherwise impregnated with a relatively soft binder composition in order to retain it in its as-formed state until individual loops are pulled off.

According to another embodiment of the invention, a plurality of pre-formed lacing cord loops are incorporated as the weft (fill) ends in a woven fabric tube. It will be appreciated that the warp yarns serve to retain the pre-formed loops, but otherwise have no function, because on withdrawing the weft loops in an axial direction, the warp threads simply fall away. Alternatively, they could be of water-soluble material to facilitate their removal.

In use, the invention makes it possible to locate the woven fabric tube over an elongated substrate, anchor one end of the lacing cord to the substrate and then draw the fabric tube along the latter, releasing and thereafter tightening the lacing cord loops progressively. The unwanted warp yarns fall away, leaving the lacing cord loops knotted about the substrate.

According to another embodiment of the invention the pre-formed loops are made from heat shrinkable filaments, so that a heat treatment after installation would cause the loops to more firmly grip the wire bundle, or other substrate.

The lacing cord may comprise more than one yarn assembled side by side, because this can simplify manufacture of the tube by weaving. It will also be appreciated that the woven tube can have any appropriate diameter; it can also be prepared in any convenient length suitable for wrapping a particular length of substrate.

In order that the invention be better understood, preferred embodiments of it will now be described by way of example with reference to the accompanying drawings in which.

Figure 1:
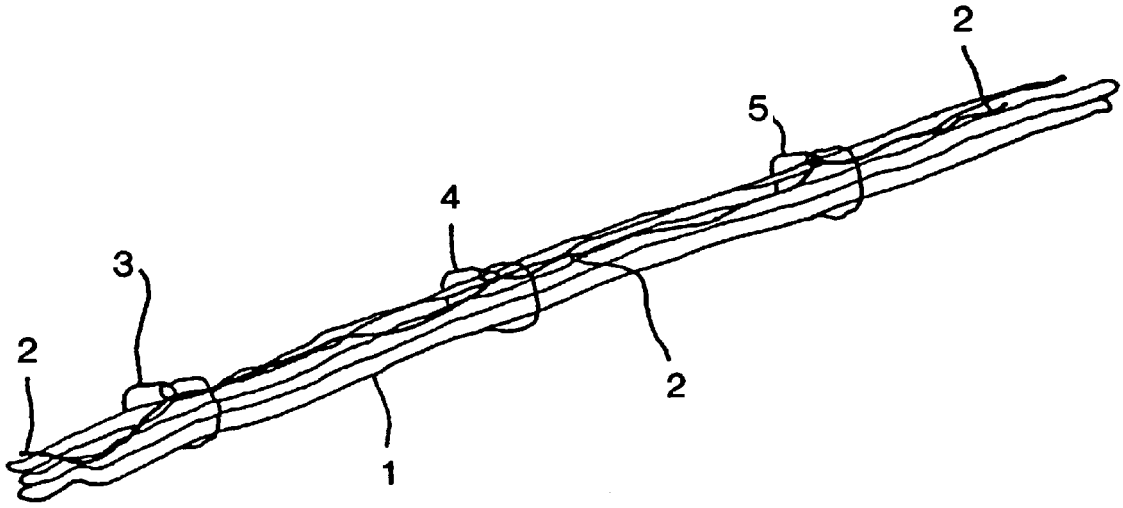
FIG. 1 PRIOR ART
FIG. 1 is a perspective view of a conventional, prior art wiring harness.

In FIG. 1, a wiring harness 1 is bundled by means of a lacing cord 2 which is successively knotted, 3, 4, 5 about the harness 1. Ordinarily and in accordance with known practices this successive knotting operation is carried out progressively, by hand, from one end of the harness to the other, successive knots, 3, 4 and 5 being separately formed, one after the other.

Figure 2:
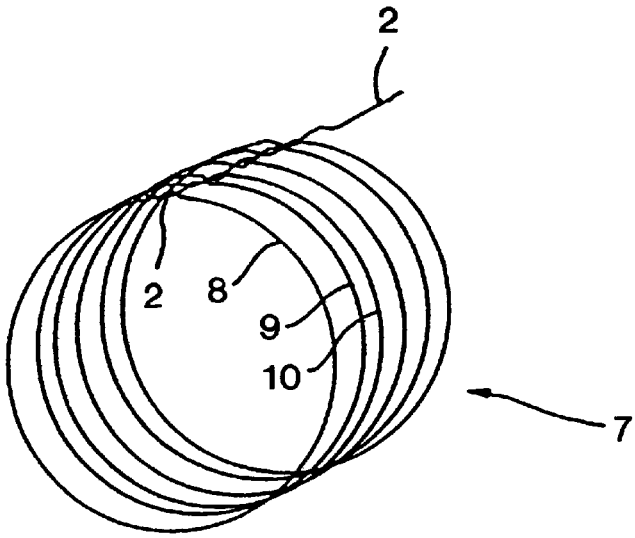
FIG. 2 is a schematic view of a set of loosely knotted loops of a lacing cord or yarn, assembled in accordance with the invention.

In FIG. 2, which demonstrates the present invention, continuous lacing cord 2 is formed with a series of slip knots expanded to define a set of knot loops 8, 9, 10 . . . of greater cross section than the harness 1 and therefore spaced therefrom. As mentioned above the knot expanded loops are also referred to herein as loosely knotted loops and respond to tension in the cord to tighten onto the harness they surround. These loops are assembled in a side-by-side relationship with respect to each other that defines a tubular formation, either on a former, or by impregnation with a relatively soft binder material such as wax.

Figure 3:
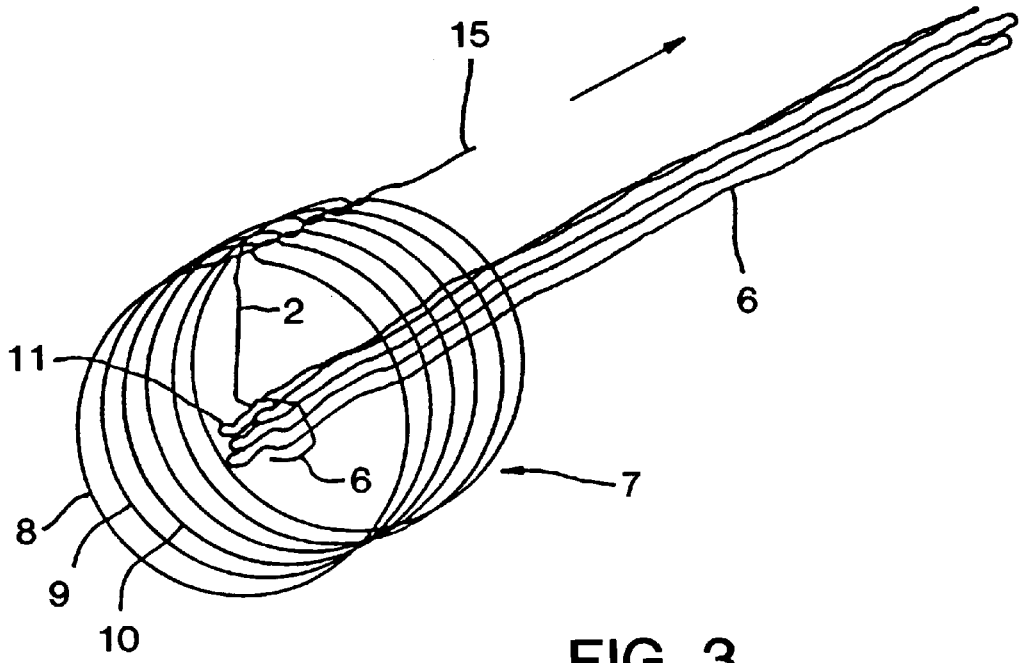
FIG. 3 is a perspective view of the set of loops of FIG. 2 located around a free end of a wiring bundle.

In FIG. 3, the assembly 7 of loops 8, 9, 10 shown schematically in FIG. 2 is again shown schematically, but this time located over a free end 11 of a wiring harness 6. One end of the lacing cord 2, is shown secured to the free harness end 11, in preparation for installation of the lacing yarn by progressively displacing the set away from the secured end and developing a tension in the cord which tightens the end loop onto the substrate, detaching it from the set. Thereafter, continued displacement of the set likewise results in tension between the previously tightened loop and the current end loop causing the latter to detach and tighten onto the substrate and so on for each loop/further displacement, thereby forming a bundled harness as shown in FIG. 1, but without the need to form each successive knot separately. If the set of loops is carried on a former, it may be possible to displace the set by pulling on the end 15 of the cord to tighten a loop onto the former for displacing former and set of loops together.

Figure 4:
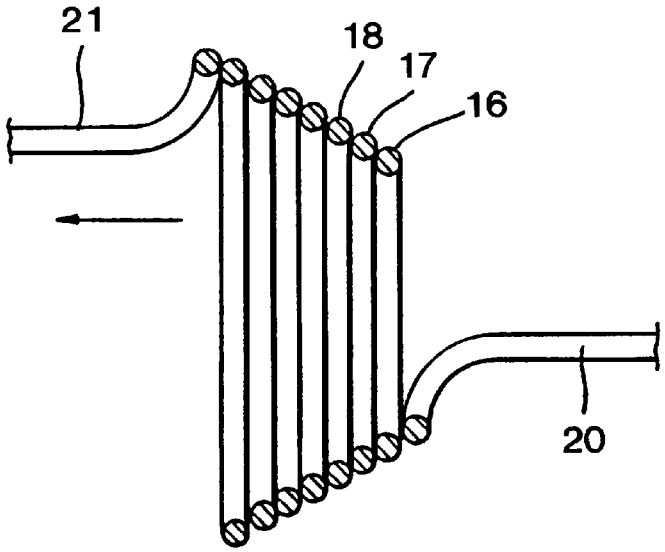
FIG. 4 is a schematic cross-sectional side view of a set of loops assembled according to a particularly preferred embodiment of the invention.

In FIG. 4, the set of loops shown in FIG. 2 is modified, by making successive loops progressively larger 16, 17, 18 in diameter to facilitate installation. It will be appreciated that in this case, installation would start with the lacing cord end 20, at the relatively small diameter end of the set of loosely knotted loops, installation taking place in the direction of the arrow. Displacing of the set may be effected by pulling on the free end 21.

Figure 5:
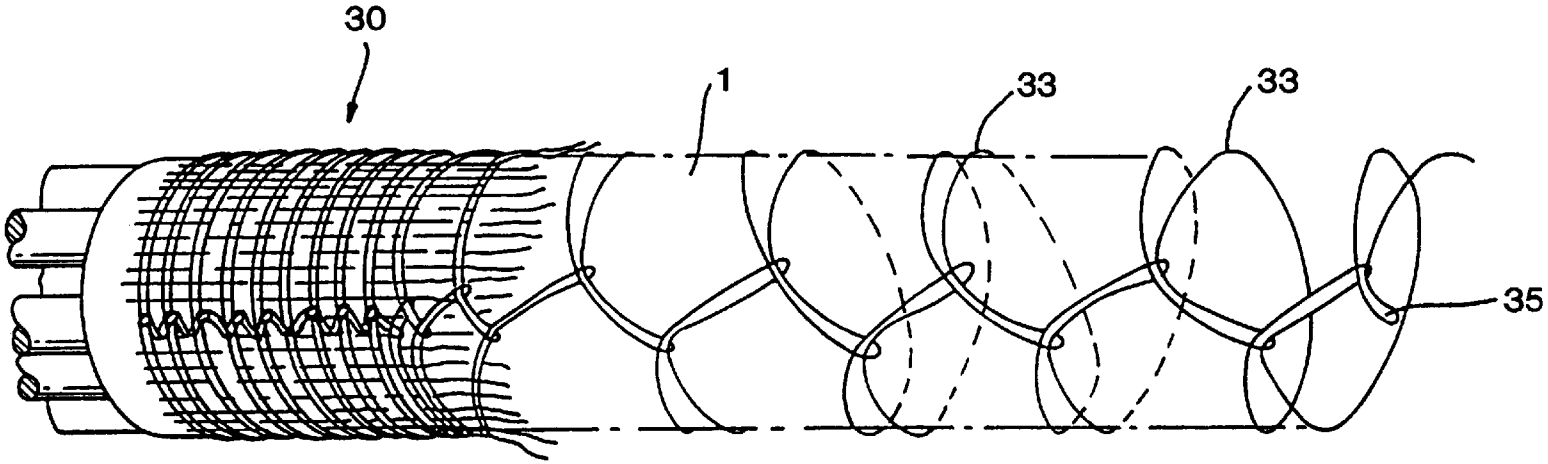
FIG. 5 is a perspective view of a further, preferred embodiment of the invention, FIGS. 5A and 5B being enlarged views of selected portions of FIG. 5.
Figure 5B:
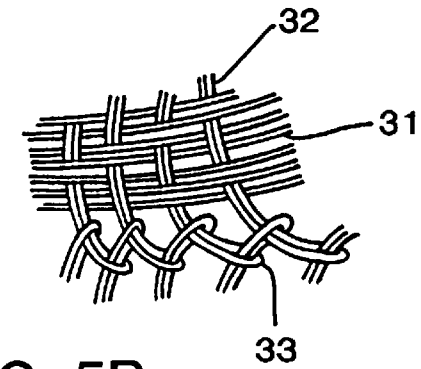
Figure 5A:
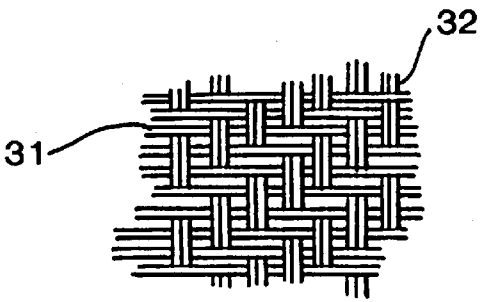

Referring now to FIGS. 5, 5A and 5B, a woven fabric tube generally designated 30 is shown enclosing a wiring harness 1 (as in FIG. 1). The tube 30 comprises axially extending warp yarns 31 and two weft yarns assembled in parallel 32, the latter being woven so as to form a succession of loops, 33 disposed axially of the tube and linked to each other in a manner that permits relative displacement as a slip knot. The latter is woven to be a clearance fit about the harness 1, to facilitate easy installation. The fabric tube and the attendant succession of loops 33 are best seen in FIGS. 5A and 5B, respectively. From FIG. 5 itself, it will be appreciated that pulling on a free end of the lacing cord constituted by the weft will result in the progressive unravelling of the latter 32 from the warp 31, so that the warp threads fall away, leaving the cord 31 looped/knotted about the harness 1. In use, the free end (designated 35 in FIG. 5) is anchored, for example by means of adhesive tape, to the harness. The fabric tube is then drawn over the harness (from right to left in FIG. 5) to form the series of spaced-apart loops 33 knotted onto the harness by virtue of the tension in the cord. The warp yarns fall away as soon as they are released by the progressive unravelling of the fabric tube. At the end of the operation, the weft is again anchored, by knotting or by adhesive tape, to yield a neatly bundled harness ready for installation.

What is claimed is:

1. A method of applying a knotted lacing cord to a bundle of elongated substrates comprising the steps of forming a set of loosely knotted side-by-side loops of larger diameter than the bundle from a continuous length of a lacing cord, placing the set of loops over a free end of said bundle and securing at least a first loop of said set to said bundle, followed by progressive lengthwise displacement of said set of loops away from said first loop lenghtwise of the bundle so as to progressively tighten successive knotted loops about the bundle at spaced intervals along the length of the latter.

2. A method according to claim 1, comprising the step of forming said set of loosely knotted loops with progressively increasing diameter from one end of the set to the other, the smallest diameter loop of the set being the loop which in use forms the first loop on the bundle.

3. A method according to claim 1, wherein said loops constitute the weft component of a tubular fabric, said tubular fabric being comprised of interwoven warp and weft components.

4. A method according to claim 3, wherein the warp component of said tubular fabric is of a water-soluble material.

5. A method according to claim 3, wherein said weft component is of a heat-shrinkable material.

6. A method according to claim 1, wherein the lacing cord is constituted by at least two yarns assembled in parallel.

7. A method according to claim 1, wherein the set of loops is treated with a relatively soft binder composition in order to maintain its as-formed state until individual loops are successively knotted about the bundle.

8. A method according to claim 1, including the step of securing the free end of the cord constituting the first step to the substrate by means of one of adhesive tape and a tie wrap.

* * * * *